US005904444A

United States Patent [19]

Kabeuchi et al.

[11] Patent Number: 5,904,444

[45] Date of Patent: May 18, 1999

[54] PROPELLING APPARATUS FOR UNDERGROUND PROPELLING CONSTRUCTION WORK

[75] Inventors: Teruo Kabeuchi; Masaya Hattori; Takashi Togawa; Yukishige Yamada; Shigeaki Okuyama; Masao Nakagawa; Siro Sugiyama; Katsuhiko Mukuno; Kazunori Tsujimoto, all of Amagasaki, Japan

[73] Assignee: Kubota Corporation, Japan

[21] Appl. No.: 08/757,257

[22] Filed: Nov. 27, 1996

[30] Foreign Application Priority Data

Jun. 13, 1996 [JP] Japan ..... 8-152390

[51] Int. Cl.[6] ..... E21B 7/04; E21B 7/08

[52] U.S. Cl. ..... 405/184; 175/73

[58] Field of Search ..... 405/154, 184; 175/73

[56] References Cited

U.S. PATENT DOCUMENTS

| | | | |
|---|---|---|---|
| 2,167,194 | 7/1939 | Anderson | 175/73 |
| 2,694,549 | 11/1954 | James | 175/73 X |
| 4,523,652 | 6/1985 | Schuh | 175/73 X |
| 5,322,391 | 6/1994 | Fisk | 405/184 X |
| 5,350,254 | 9/1994 | Fisk et al. | 405/184 |
| 5,535,835 | 7/1996 | Walker | 175/73 |
| 5,597,046 | 1/1997 | Fisk | 405/184 X |
| 5,695,014 | 12/1997 | Jenne | 175/73 X |

*Primary Examiner*—Tamara L. Graysay
*Assistant Examiner*—Tara L. Mayo
*Attorney, Agent, or Firm*—Webb Ziesenheim Bruening Logsdon Orkin & Hanson, P.C.

[57] ABSTRACT

A propelling apparatus includes a plurality of propellant cylinders series-connected to each other to be propelled by receiving a pushing force from behind, joints for series-connecting the propellant cylinders, a propellant head connected to a forward-most end of the propellant cylinders to be pressed into the earth, a leader member constituting a leading end of the propellant head, the leader member being rotatable about an axis of the propellant head by receiving a driving force from a driving device. An inclined pressure-receiving face is formed at a forward portion of the leader member for receiving an earth pressure in association with the underground propelling movement of the propellant head and steering the propellant head toward the direction of application of the earth pressure to the pressure-receiving face. The joint includes a flexible joint which is pivotally flexible about a transverse axis extending normal to an axis of the propellant cylinder.

20 Claims, 10 Drawing Sheets

PROPELLING APPARATUS FOR UNDERGROUND PROPELLING CONSTRUCTION WORK

BACKGROUND OF THE INVENTION

1. Field of the Invention

The present invention relates to a propelling apparatus for use in an underground propelling construction work. The invention more particularly relates to a propelling apparatus including a plurality of propellant cylinders series-connected to each other via joints to be propelled by receiving a pushing force from behind, a propellant head connected to the forward-most end of the propellant cylinders for digging the earth, the propellant head having at a leading end thereof a leader member rotatable about an axis of the propellant head by receiving a driving force from a drive means, the leader member having at a forward portion thereof an inclined pressure-receiving face for receiving an earth pressure in association with the underground propelling movement of the propellant head and steering the propellant head toward the direction of application of the earth pressure to the pressure-receiving face.

2. Description of the Related Art

For effecting a branch-piping work for extending a lead-in pipe from a gas branch pipe (denoted by a mark P in FIG. 9) installed under a road to a gas piping system (denoted by a mark G in FIG. 9) installed in a domestic residence, for instance, pits are dug in the earth at a site corresponding to a base end (referred to simply as 'base end' hereinafter) (denoted with a mark 'D' in the figures) of the lead-in pipe and at a further site corresponding to a leading end (referred to simply as 'leading end' hereinafter) (denoted with a mark 'E' in the figures) of the lead-in pipe, respectively (normally, the pit at the base end is formed in advance. (normally, the pit at the base end is formed in advance. Hence, there is no necessity of newly forming this pit). Also, there is employed an underground propelling apparatus ('reference apparatus' hereinafter) including a plurality propellant cylinders series-connected to each other in an inflexible manner, i.e. without flexibility at the joints between the respective cylinders. Then, this reference apparatus is propelled straight under the ground to form a straight cylindrical underground hole, in which the lead-in pipe is installed horizontally. Thereafter, the leading end of the installed lead-in pipe is connected to a terminal end of the domestic gas piping systems. However, in the case of this pipe lead-in operation using the reference apparatus, the operation requires formation of a pit at the leading end and then again filling the pit with the earth after the pipe installment. These digging and filling operation of the pit at the leading end are troublesome. In addition, if there is no space available for forming the pit, the pipe installing operation is impossible entirely.

In order to avoid the above inconveniences, according to a proposal made by the conventional art, in the apparatus of the above-noted type, its propellant cylinders are interconnected via joints which allow omnidirectional flexion, and the drive means is provided as a hydraulic motor whose output shaft is operatively connected with the drive shaft (this conventional apparatus will be referred to as 'first conventional apparatus' hereinafter).

In the case of the above first conventional apparatus, the apparatus is first propelled straight (for this straight propelling movement, the posture of the leader member is reversed repeatedly so as to alternately orient the inclined pressure-receiving face to the upward and the downward and the leader member is continuously driven to rotate). In the vicinity of the leading end, by fixedly setting the inclined pressure-receiving face downwards, the propelling apparatus is driven with an upward inclination so as to reach and break through the ground surface. Thus, by using this apparatus, the pipe installation work does not require the preliminary formation of the pit at the leading end (this installation operation will be referred to as 'arrival pit-less construction method' hereinafter).

With the above first conventional apparatus, however, if the apparatus has a small diameter, it may be difficult to obtain a correspondingly small hydraulic motor which can be accommodate with the apparatus. And, as such small hydraulic motor can only provide a limited torque for driving the drive shaft and rotating the leader attached to the leading end of the shaft, there tends to arise the necessity of additionally providing some mechanism for increasing the torque (specifically, e.g. a reduction mechanism). This is a problem inherently present in the first conventional apparatus.

In order to solve these problems with the first conventional apparatus described above, the present inventors developed an improved apparatus previously (this apparatus will be referred to as 'second conventional apparatus' hereinafter). In this apparatus, while the construction of the joints is maintained the same as that of the first conventional apparatus, a mechanism entirely different from the hydraulic motor is employed as the drive mechanism. Specifically, this mechanism comprises a rotary mechanism including, as a major component thereof, a spiral screw consisting essentially of a spiral ridge 71*a* and a spiral groove 61, as shown in FIG. 14.

More particularly, with further reference to FIG. 14, the rotary mechanism includes the spiral groove 61 formed at a portion of an inner peripheral face of a propellant head body 1A, a hydraulic piston 71 having the spiral ridge 71*a* threadable with the spiral groove 61 and incorporated within the propellant head body 1A, a rotary shaft 81 (corresponding to the drive shaft for the propellant head) forming in an outer periphery thereof a splined shaft portion 81*a* engageable with spline grooves 71*b* defined in the inner face of the hydraulic piston 71, and a pair of pressure-oil feeding passages 91A, 91B for feeding and discharging pressure oil to and from pressure-receiving chambers disposed side by side across a piston head 71*c* of the hydraulic piston 71 so as to reciprocally drive the hydraulic piston 71 along the axis of the head body 1A.

With the above-described rotary mechanism in operation, the pressure oil is fed through one pressure-oil feeding passage 91A (or 91B) to the propellant head body 1A and the oil is returned from the head body 1B through the other pressure-oil feeding passage 91B (or 91A). With these, the hydraulic piston 71 is reciprocally driven. In association with this reciprocal movement, the hydraulic piston 71 having its spiral ridge 71*a* threaded with the spiral groove 61 of the head body 1A is rotated forwardly and reversely, the rotary shaft 81 also is rotated forwardly and reversely, and also the leader member 1D of the propellant head 1 is driven to rotate about its axis. In this, the leader member 1D is rotated by about 360 degrees or more with one reciprocal movement of the hydraulic piston 71.

However, in the case of both the first and second conventional apparatuses, the interconnecting portions are constructed from the omnidirectionally flexible joints. This causes a problem to be described next. That is, the control of the propelling direction needs to be effected omnidirectionally, i.e. in all of the upper, lower and right and left directions. Hence, the propelling control of the apparatuses tends to be complicated. Such complexity has made it considerably difficult to facilitate and speed up the underground propelling construction work and also to reduce the cost of the control system. This is the problem common to the first and second conventional apparatuses.

The present invention has attended to the above-described states of the art. A primary object of the invention is to provide means capable of solving not only the problem of the reference apparatus but also the problem unique or common to one or both the first and second conventional apparatuses and capable of allowing smooth flexible propulsion of the propelling apparatus afforded by the flexible joints used therein.

SUMMARY OF THE INVENTION

For accomplishing the above-noted object, a propelling apparatus, according to the present invention, comprises:

a plurality of propellant cylinders series-connected to each other to be propelled by receiving a pushing force from behind;

joint means for series-connecting the propellant cylinders;

a propellant head connected to a forward-most end of the propellant cylinders to be pressed into the earth;

a leader member constituting a leading end of the propellant head, the leader member being rotatable about an axis of the propellant head by receiving a driving force from drive means;

an inclined pressure-receiving face formed at a forward portion of the leader member for receiving an earth pressure in association with the underground propelling movement of the propellant head and steering the propellant head toward the direction of application of the earth pressure to the pressure-receiving face;

wherein the joint means includes a flexible joint which is pivotally flexible about a transverse axis extending normal to an axis of the propellant cylinder.

With the above-described construction, the joint means includes a flexible joint which is pivotally flexible about a transverse axis extending normal to the axis of the propellant cylinder, so that the propellant cylinder may be flexed in one predetermined direction alone, i.e. the direction about the transverse axis. Then, the direction of this flexion will be appropriately set in combination with setting of the orientation of the inclined pressure-receiving face. More particularly, in effecting a branch-piping installing operation for installing a lead-in pipe extending from a branch gas pipe to be connected with a domestic gas piping system, the lead-in pipe will be first propelled straight, and then, when the leading end of the pipe comes to the vicinity of the terminal end of the domestic gas piping system, the flexible joint portion is flexed in the predetermined one direction with setting the orientation of the inclined pressure-receiving face downwards, so that the propelling apparatus is propelled with the upward inclination to reach the ground surface. In this manner, the installing operation of a lead-in pipe may be effected by the arrival pit-less construction method described hereinbefore.

Moreover, since the joint means is flexible only in the one predetermined direction, the control of the propelling direction needs to be effected mainly in this one direction alone.

As a result, the above-described construction of the invention has made it possible to solve the problem of the reference apparatus, i.e. the trouble of forming and refilling a pit at the leading end and solving also the problem unique or common to one or both the first and second conventional apparatuses, i.e. the problem of complicated control construction, thus making it possible to facilitate and speed up the underground propelling construction work and also to reduce the cost of the control system.

Preferably, the propellant head includes angular displacement detecting means capable of detecting change in the angular posture of the propellant head about its axis.

With this additional feature, when effecting the branch-piping installing operation for installing a lead-in pipe extending from a branch gas pipe to be connected with a domestic gas piping system as described hereinbefore, if the angular posture of the propellant head about the axis is inadvertently changed in the course of the straight propelling movement of the lead-in pipe, this change in the posture is detected by the angular displacement detecting means, so that based on this detection information the angular, i.e. rotary posture may be corrected appropriately.

According to one aspect of the invention, the drive means includes:

a cylinder chamber formed between the head body and the drive shaft and having an annular or cylindrical configuration;

a blade member slidably contacting an inner peripheral face of the cylinder chamber and projecting radially for dividing capacity-wise the cylinder chamber into two cylinder sub-chambers across the drive shaft; and fluid feed openings for respectively feeding pressure fluid into the two cylinder sub-chambers divided by the blade member.

With the above-described construction, by feeding the pressure fluid through one fluid feed opening into one cylinder sub-chamber to apply the fluid to the blade member, the drive shaft may be rotated in one direction about the axis. Also, by feeding the fluid through the other fluid feed opening into the other cylinder sub-chamber to apply the fluid to the blade member, the drive shaft may be rotated in the other direction about the axis. In these manners, the drive shaft may be readily rotated forwardly and reversely, and in association therewith the leader member of the propellant head too may be rotated forwardly and reversely about the axis with big torque. Moreover, this rotary mechanism can be constructed simply by forming the cylinder chamber divided into the two sub-chambers, with the blade member being disposed inside the chamber. Accordingly, for providing the cylinder chamber divided into the two sub-chambers, the above construction of the invention does not require such large radial space as required by the first conventional apparatus. Further, this construction does not require either such large longitudinal space as required by the second conventional apparatus.

Preferably, between the cylinder head body and the drive shaft, the cylinder chamber includes, at a peripheral portion thereof, a partitioning wall as a non-rotary region; and the leader member is attached to the drive shaft in such a manner that the non-rotary region of the inclined pressure-receiving face formed by the partitioning wall is disposed at one terminal end of the transverse axis in the peripheral direction of the propellant head.

With the above-described construction, the leader member is attached to the drive shaft in such a manner that the non-rotary region of the inclined pressure-receiving face formed by the partitioning wall is disposed at one terminal end of the transverse axis in the peripheral direction of the propellant head. Then, when the propelling apparatus is propelled with unidirectional flexion thereof due to the function of the joint means, the peripheral position of the propellant head for directing the inclined pressure-receiving face to a desired direction is already set conveniently.

Preferably, the joint means includes a plurality of flexible joint portions and a plurality of inflexible joint portions provided alternately in a propelling apparatus body with longitudinal spaces therebetween.

More preferably, each of the flexible joint portions is flexible only about a flexion axis extending radially of the propelling apparatus body, and each of the inflexible joint portion includes a positioning mechanism for parallel aligning the flexion axes of the flexible joint portions disposed across this inflexible joint portion in association with a joining operation of the inflexible joint portion.

With the above, with the simple joining operation of the inflexible joint portion, the flexion axes of the flexible joint portions disposed side by side across the inflexible joint portion may be aligned in parallel to each other, thus eliminating the trouble of peripheral alignment of the propellant cylinders to be connected with each other. As a result, the underground propelling operation may be effected in an efficient manner. Moreover, the joining operation may be readily effected in the same manner and regardless of the skill or experience of the operator.

Also, as the flexion axes of the respective flexible joint portions are aligned in parallel to each other, it is possible to maintain uniform the underground flexion direction of the propelling apparatus. So that, the control of the propelling direction may be further easier. As a result, the efficiency of the entire underground propelling operation may be improved.

Preferably, the inclined pressure-receiving face is formed so as to cross the transverse axis.

With this, the earth pressure applied to the pressure-receiving face in association with the propelling movement of the apparatus will act in a direction for urging the propelling apparatus to be flexed about the flexion axis. Hence, the flexed propelling movement may be effected efficiently, without necessitating complicated propelling control scheme.

Incidentally, the apparatus of the invention may be used for any other purpose than the branch-piping installment operation of the lead-in pipe from a branch gas pipe. Further, in the above description, the propelling direction of the apparatus is first set straight and then changed to either the upper or lower direction in the midst of the propelling process. The use of the apparatus is not limited thereto. For instance, it is also possible to change the course of the apparatus to either the right or left direction after the straight movement.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of a propelling apparatus for use in an underground propelling construction work, to which the present invention relates, will be described in details with reference to the accompanying drawings.

Figure 1:
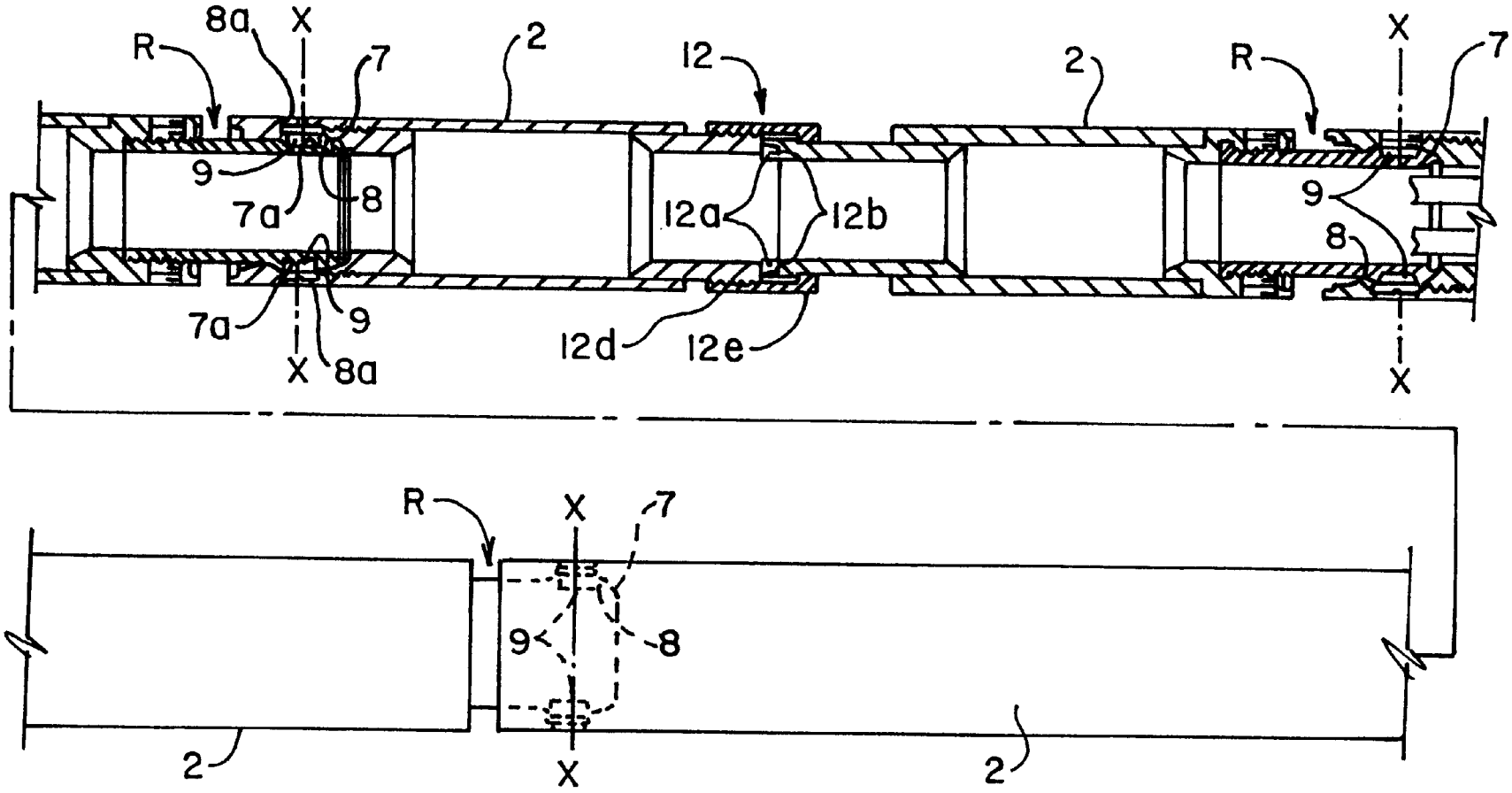
FIG. 1 is a horizontal section showing principal portions (the joint portions of plural propellant cylinders) of an apparatus according to one preferred embodiment.
Figure 2:
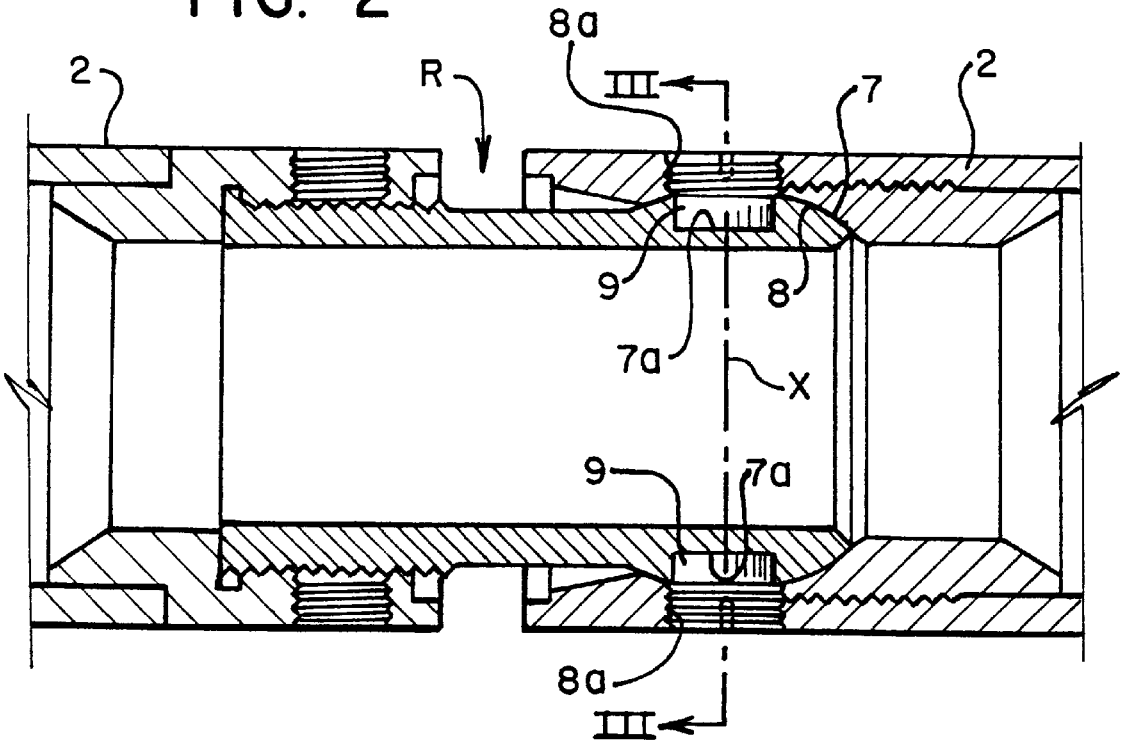
FIG. 2 is an enlarged view of the joint portions.
Figure 3:
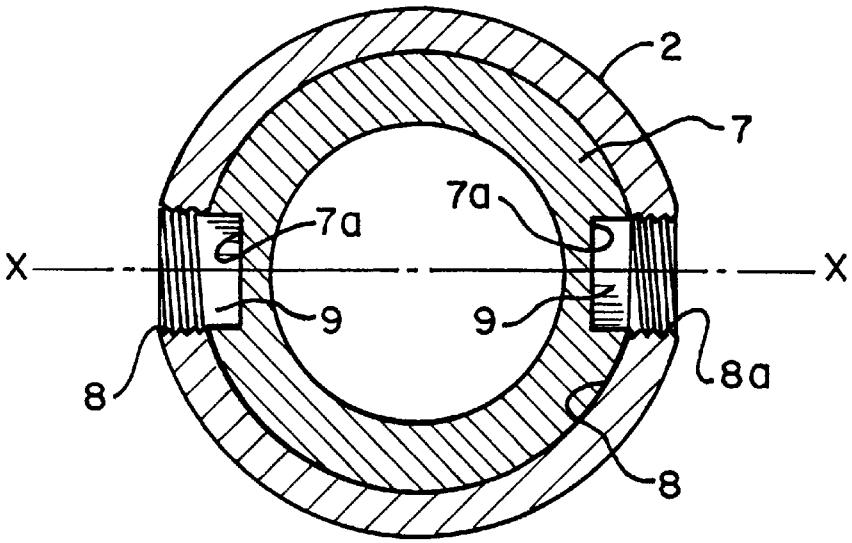
FIG. 3 is a section view taken along a line III—III in FIG. 2.
Figure 4:
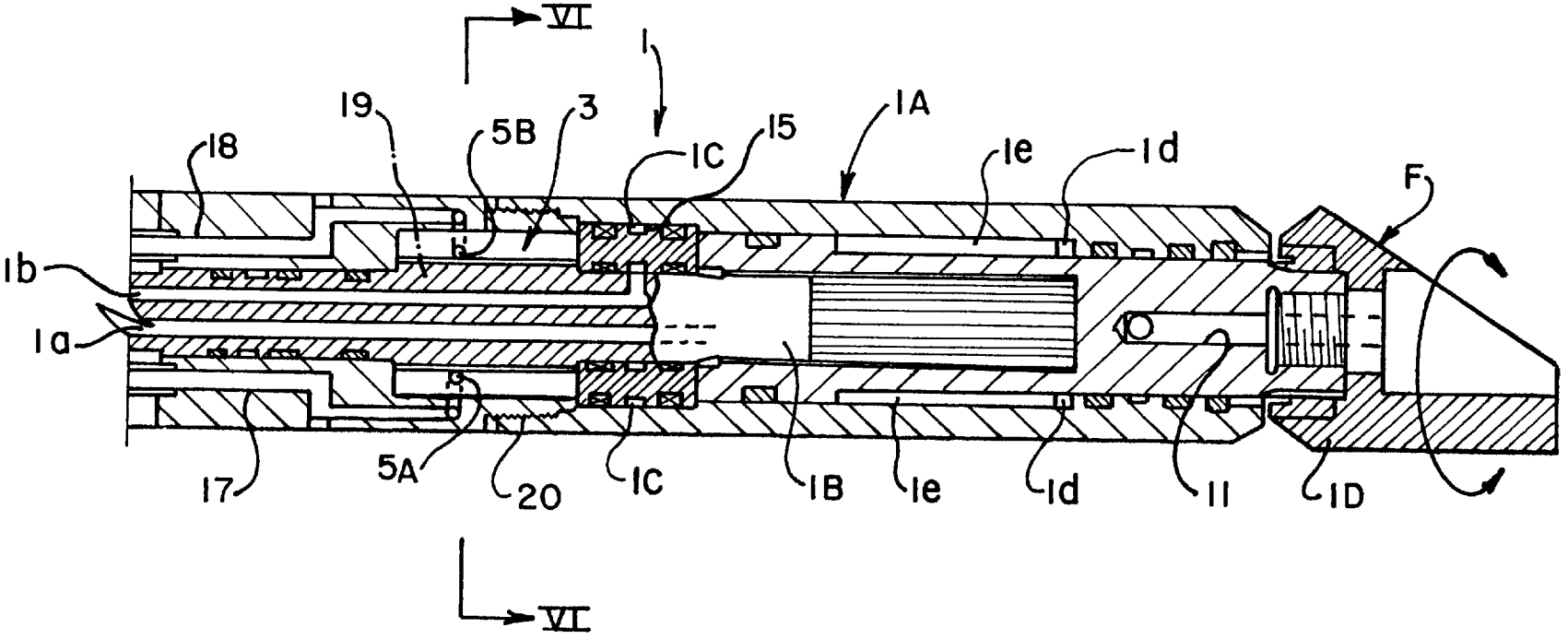
FIG. 4 is a vertical section showing principal portions of a propellant head of the apparatus.

As shown in FIGS. 1 through 3 (showing the joined condition of a plurality of propellant cylinders) as well as in FIG. 4 (showing a propellant head attached to a forward-most leading end of the propellant cylinders), an apparatus according to one embodiment includes a plurality of propellant cylinders 2 each having a small diameter (e.g. about 100 mm or less) flexibly and serially connected to each other via joint portions R constituting joint means pivotally flexible about a transverse axis X extending normal to the axis of the propellant cylinder 2. Further, to the forward-most terminal end of the propellant cylinders 2, there is attached a propellant head 1 having a substantially cylindrical outer peripheral face. Incidentally, in the case of the apparatus of the instant embodiment, the joint portion of the propellant head 1 is constructed identically to the joint portion R for interconnecting the propellant cylinders 2.

Figure 5:
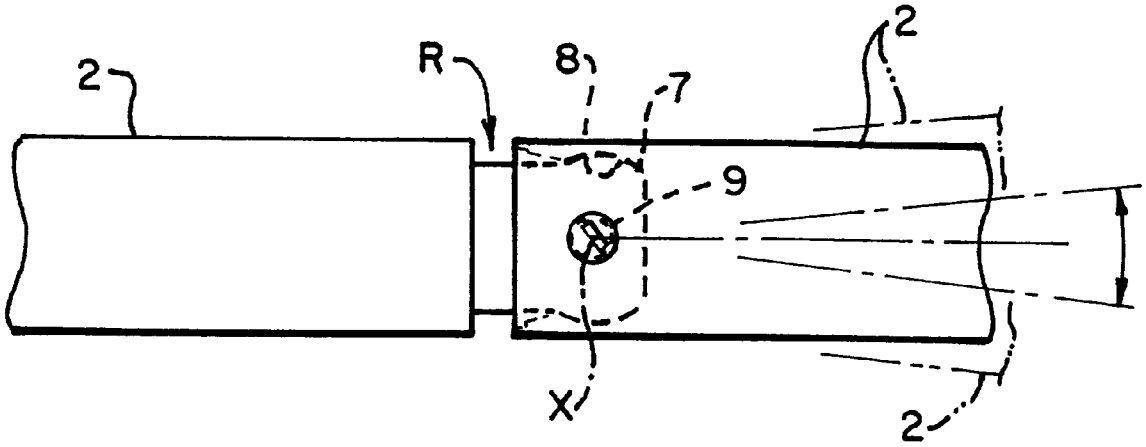
FIG. 5 is an function-illustrative view of the joint portions.

As shown more particularly in FIGS. 1 through 3, the joint portion R includes a spherical engaging portion 7 provided at the leading end of each propellant cylinder 2, and another spherical engaging portion 8 provided at the base end of the propellant cylinder 2 and inwardly engageable with the engaging portion 7, with the spherical engaging portions 7, 8 being interconnected to each other via a pin 9 as a connecting means to be pivotally flexible about the transverse axis X. One end of the pin 9 is substantially gaplessly fitted within a recess 7*a* formed at portions (opposed two positions) of the outer surface of the spherical engaging portion 7, with the recess 7*a* extending depth-wise along the transverse axis X. Also, the other end of the pin 9 is threaded into a through threaded hole 8*a* formed at portions (two positions corresponding to the recess 7*a*) of the spherical engaging portion 8, with the extending direction of the hole 8*a* being along the transverse axis X. Then, with the engagement by insertion of the opposed ends of the pin 9, the joint portion R may be pivotally flexed about the transverse axis X as illustrated in FIG. 5.

Incidentally, if the thickness of one terminal end of the pin 9 is varied so as to allow this end of the pin 9 to be fitted within the recess 7*a* with a sufficient gap therebetween, the joint portion R will become pivotally flexible in a desired direction by an extend permitted by the gap. That is to say, by using a different pin 9, it is readily possible to switch over the joint portion R from the condition in which the portion may be pivotally flexible about the transverse axis X and the further condition in which the portion may be pivotally flexible in any desired direction.

Figure 7:
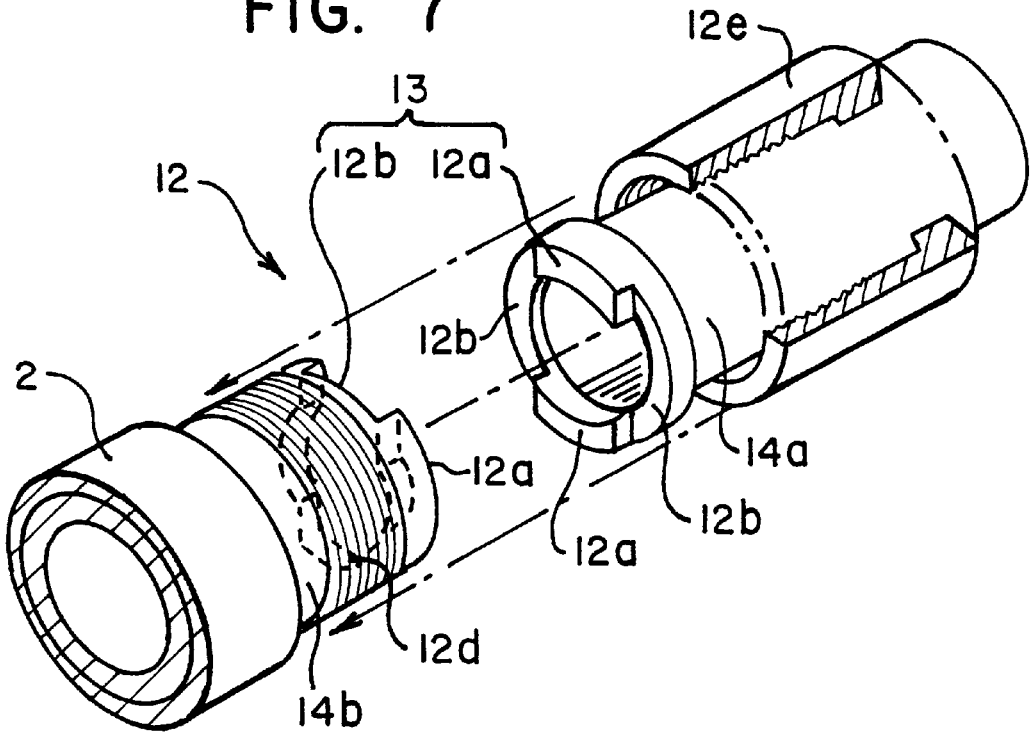
FIG. 7 is a perspective view showing an intermediate joint portion provided at an intermediate connecting portion of the propellant cylinder.

At an intermediate portion of some propellant cylinders 2 selected from the plurality of propellant cylinders 2, as shown in FIG. 7, each selected propellant cylinder 2 is detachable, when necessary (e.g. when it is desired to coil and store the plurality of inter-connected propellant cylinders 2 in a most compact manner), into halves via a registering integrating portion 12. More particularly, at this registering integrating portion 12 for providing the above-described detachable engagement, a convex portion 12*a* formed in one half portion 14*a*and a concave portion 12*b* formed in the other half portion 14*b* are engageable with and disengageable form each other through threaded engagement between a male thread portion 12*d* and a female thread portion 12*e*. And, the convex portion 12*a*and the concave portion 12*b* are phase-displaceable relative to each other by 180 degrees about the drive shaft axis. Accordingly, the convex portion 12*a* and the concave portion 12*b* together constitute a positioning mechanism 13.

As shown in FIG. 4, the propellant head 1 includes a cylindrical head body 1A constituting the body of the head and functioning also as a cylinder, a drive shaft 1B fitted within the head body 1A to be movable back and forth along the propelling direction in response to feeding of drive fluid (i.e. pressure oil, lubricant or the like) so as to function as a piston for the cylinder, and a leader member 1D attached to the leading end of the drive shaft 1B. In operation, in association with the forward and rearward movement of the drive shaft 1B, the leader member 1D is driven reciprocally along the propelling direction, so that with this reciprocal movement of the leader member 1D the propellant head 1 may be smoothly advanced in the propelling direction. And, with this advancing movement of the propellant head 1, the plurality of propellant cylinders 2 too are propelled smoothly.

In the above, the pressure oil is introduced through a fluid feed passage 1*a* toward the leader member 1D and then flows inside the drive shaft 1B (in the figure, this fluid flow is shown only to a middle portion thereof in order to avoid complexity in the figure) and into the rear end of the leader member 1D to the leading end thereof. For reversibly moving the leader member 1D, the pressure fluid is introduced through a fluid feed passage 1*b* different from the above passage 1*a*. Then, this fluid runs through an oil passage 1*c* formed annular in the inner peripheral face of the propellant head body 1A and then the fluid runs into an oil passage (not shown) extending from this oil passage 1*c* to an inlet opening 1*d* of an oil passage 1*e* formed adjacent the leading end. Further, the fluid introduced into the inlet opening 1*d* is then guided to the oil passage 1*e* provided adjacent the leading end, whereby the drive shaft 1B is reversely moved.

The leader member 1D may have a discharge opening 11 for forwardly discharging therethrough the lubricant fluid (this lubricant fluid functions also as the driving pressure fluid as described hereinbefore). The drive shaft 1B and the leader member 1D attached to the leading end thereof are driven about the axis by a driving means to be described in the next section. At a leading face of the leader member 1D, there is formed an inclined pressure-receiving face F. In operation, as the drive shaft 1B and the leader member 1D are driven to rotate to an appropriate direction, the leader member 1D is steered toward the direction of the application of the earth pressure to the inclined pressure-receiving face F.

Next, the construction of the drive means will be described.

Figure 6:
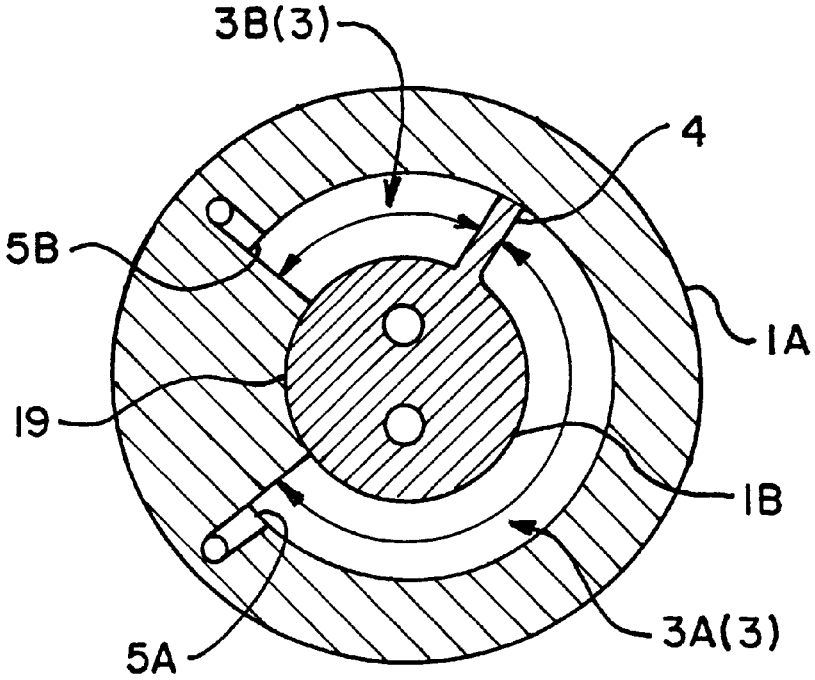
FIG. 6 is a section view taken along a line VI—VI in FIG. 4.

As shown in FIGS. 4 and 6, between the head body 1A and the drive shaft 1B, there is formed an annular or cylindrical (annular in the instant embodiment) cylinder chamber 3. In this cylinder chamber 3, the cylindrical space between the cylinder head 1A and the drive shaft 1B is partitioned by a cylindrical partitioning member 15 incorporated within the head body 1A, and also the cylindrical space is closed partially in the peripheral direction thereof by means of a partitioning wall 19 (this partitioning wall 19 constitutes a non-rotary region of a blade member 4 to be described later) projecting from the head body 1A and having a fan shape with an enlarged root portion (widening angle: 80°), whereby the entire space obtains a substantially C-shaped cross section. And, as shown in FIG. 6, from the drive shaft 1B, there is radially projected a blade member 4 which comes into slidable contact with the inner peripheral face of the cylinder chamber 3 and divides spatially the cylinder chamber 3 into two, i.e. cylinder sub-chambers 3A, 3B (i.e. the cylinder sub-chamber 3A defined by one side of the partitioning wall 19 and one side of the blade member 4 and the cylinder sub-chamber 3B defined by the other side of the partitioning wall 19 and the other side of the blade member 4). Then, as also shown in FIG. 6, there are provided fluid feed openings 5A, 5B for feeding respectively and independently the pressure fluid into these sub-chambers 3A, 3B.

Incidentally, in order to allow the drive shaft 1B to be disposed within the head body 1A with the blade member 4 being fitted within the cylinder chamber 3, it is necessary for the head body 1A to have a dividable construction dividable at a dividing portion 20.

As shown in FIG. 4, a flow passage for guiding the pressure fluid to one fluid feed opening 5A of the fluid feed openings 5A, 5B is formed to extend through a pressure-fluid feed pipe 17 provided within the base end of the head body 1A and further extend longitudinally through the thick portion of the head body 1A to reach the one fluid feed opening 5A. Further, as also shown in FIG. 4, another flow passage for guiding the pressure fluid to the other fluid feed opening 6B is formed to extend through a pressure-fluid feed pipe 18 provided within the base end of the head body 1A and further extend longitudinally through the thick portion of the head body 1A to reach the other fluid feed opening 5B.

With the above-described construction, as the pressure fluid is fed through the one fluid feed opening 5A into the one cylinder sub-chamber 3A of the two cylinder sub-chambers 3A, 3B to apply the fluid pressure to the blade member 4, the drive shaft 1B may be rotated in one direction about the axis of the drive shaft 1B. Also, as the pressure fluid is fed through the other fluid feed opening 5B into the other cylinder sub-chamber 3B to apply the fluid pressure to the blade member 4, the drive shaft 1B may be rotated in the other direction about the axis of the drive shaft 1B. Accordingly, the drive shaft 1B may be easily rotated forwardly and reversely (the rotational range is 280 degrees since the widening angle of the partitioning wall 19 is 80 degrees as described hereinbefore). In association with this rotation, the leader member 1D of the propellant head 1 too is rotate with a big torque in the forward and reverse directions about the longitudinal axis of the head body 1A. Moreover, this rotary mechanism can be readily constructed by providing the cylinder chamber 3 sectioned into the cylinder sub-chambers 3A, 3B with the blade member 4 being disposed inside the chamber 3. Therefore, it is not necessary to reserve a large radial space in the apparatus for providing the cylinder chamber 3 divided into the two cylinder sub-chambers 3A, 3B, and this construction does not require a large longitudinal space, either.

Further, in this propelling apparatus, the leader member 1D is attached to the drive shaft 1B in such a manner that the non-rotary region of the inclined pressure-receiving face F formed by the partitioning wall 19 is disposed at one terminal end of the transverse axis X in the peripheral direction of the propellant head 1. That is, in this embodiment, the attachment of the leader member 1D to the drive shaft 1B is done so that the peripheral position of the partitioning wall 19 as the non-rotary region of the blade member 3 is set at either end of the transverse axis X and the non-rotary region of the inclined pressure-receiving face F formed by the partitioning wall 19 is located at the end of the transverse axis X in the peripheral direction of the propellant head 1.

Figure 8:
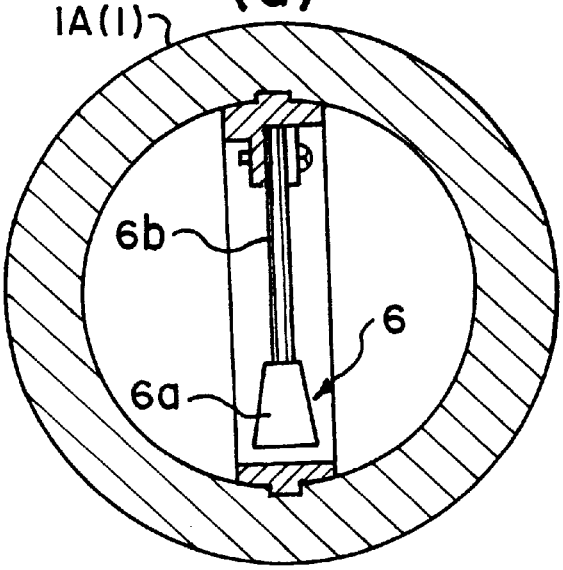
FIG. 8 is a descriptive view of a rolling gauge incorporated within the propellant head.
Figure 8:
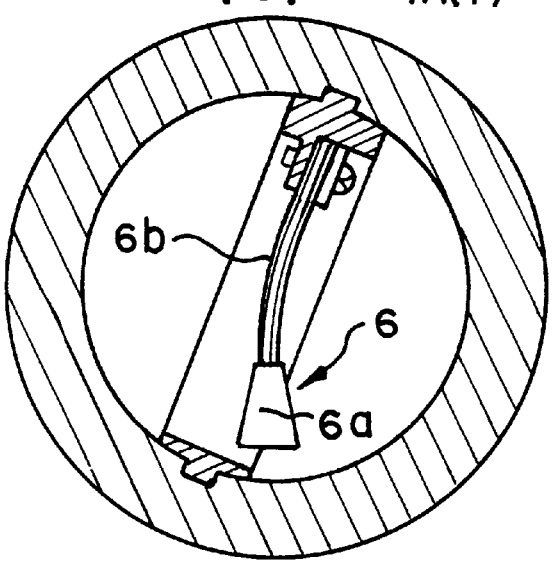

Moreover, in the present embodiment, the propellant head 1 is provided with a rolling gauge 6 (see FIG. 8) as an angular displacement detecting means capable of detecting change in the angular posture of the propellant head 1 about the axis. More particularly, a planar rod member 6*b* suspending a weight 6*a* therefrom is attached to the head body 1A of the propellant head 1, and strain gauges (not shown) are affixed to front and rear faces of this rod member 6*b*. In operation, in association with a rotation of the propellant head 1 about its axis, the rod member 6*b* is bent by the mass of the weight 6*a* as illustrated in FIG. 8(*b*), so that the strain gauges measure the amount of strain corresponding to the bending amount. And, based on this measured value, the angular posture of the propellant head may be determined.

As the angular displacement detecting means, instead of the rolling gauge having the strain gauges, an alternative construction is conceivable in which a coil resistor is provided peripherally within the propellant head 1. In this case, when the propellant head 1 is rotated about its axis, the rod member 6*b* comes into sliding contact with the coil resistor, which generates a change in the electric potential. And, this potential change is detected by a potentiometer, thereby to detect the angular position.

Figure 9:
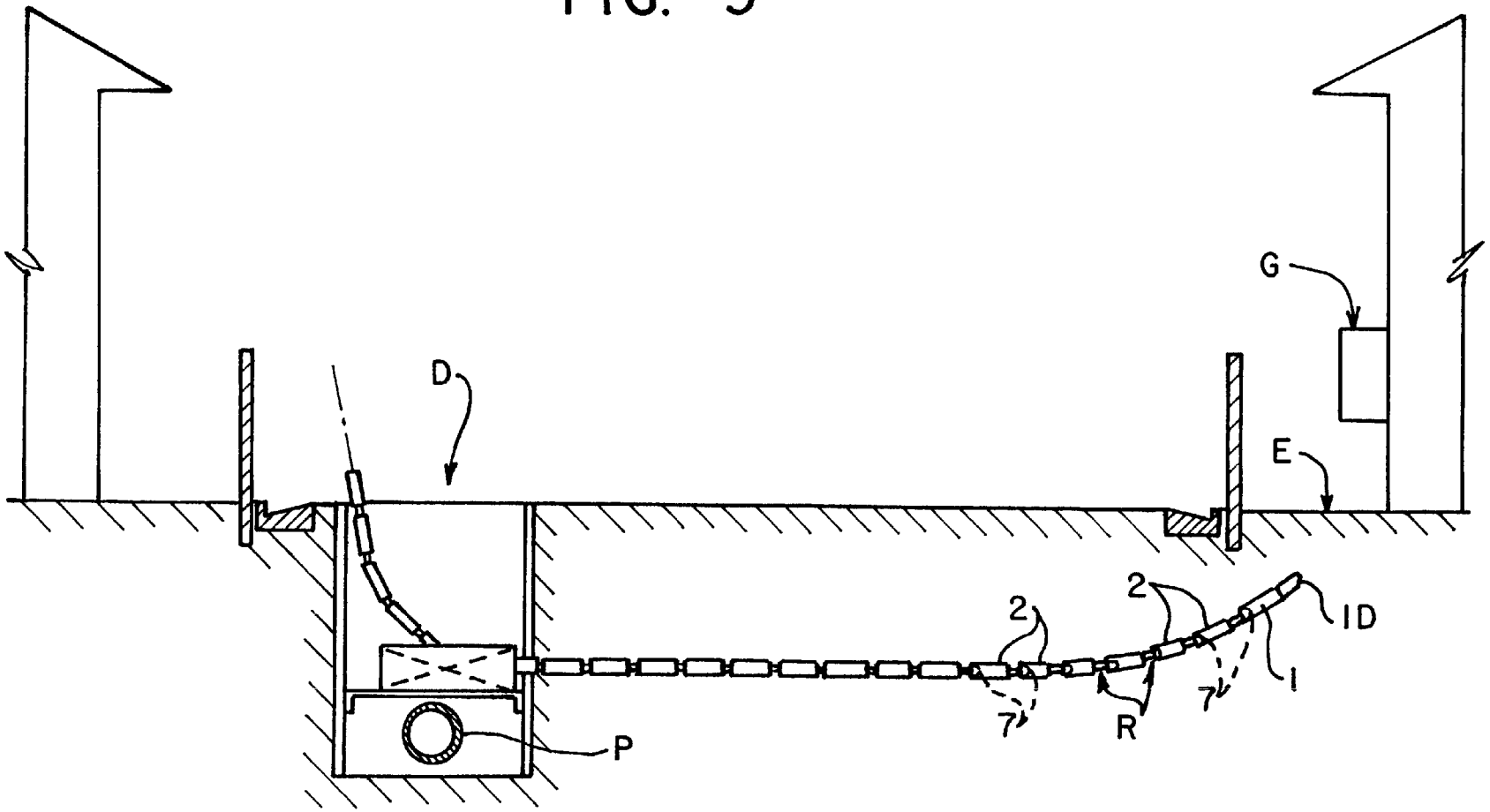
FIG. 9 is a view illustrating an in-use condition of the apparatus of the invention.

Then, for effecting a branch-piping installment operation for installing a lead-in pipe from a gas branch pipe P installed under e.g. a road to a domestic gas piping system G by using the invention's apparatus described above, as illustrated in FIG. 9, from a pit formed in advance at a site (referred to as the 'base end D' hereinafter) corresponding to the base end of the lead-in pipe toward a ground surface site (referred to as the 'leading end E' hereinafter) corresponding to the leading end of the lead-in pipe, the propelling apparatus of the invention is caused to be propelled underground. More particularly, after the propelling apparatus is propelled straight (for this straight propelling movement, the posture of the leader member 1D is reversed repeatedly in order to alternately orient the inclined pressure-receiving face F upwards and downwards), in the vicinity of the leading end E, the inclined pressure-receiving face F is fixedly set downwards alone so as to advance the propelling head 1 with an upward inclination, so that the forward-most end of the propelling apparatus, i.e. the leading end of the propellant head 1 may reach the ground surface, even if a pit was not formed in advance at the leading end E. In this manner, the arrival pit-less construction method described hereinbefore may be effected readily. Further, as the joint portions R are flexed only in the one predetermined direction, the control of the propelling direction too may be effected mainly as for this one predetermined direction alone. Accordingly, the control of the propelling direction may be easily carried out. In addition, as described hereinbefore, the leader member 1D is attached to the drive shaft 1B in such a manner that the non-rotary region of the inclined pressure-receiving face F formed by the partitioning wall 19 is disposed at one terminal end of the transverse axis X in the peripheral direction of the propellant head 1. Therefore, when the propelling apparatus is propelled with the upward inclination with the joint portions R flexible in the one predetermined direction alone, the propellant head 1 has already been fixed in peripheral position thereof for appropriately orienting the inclined pressure-receiving surface F relative to the propellant cylinders 2.

Further, in this embodiment, the propellant head 1 is provided with the rolling gauge 6 capable of detecting change in the angular posture of the propellant head 1 about the axis. Thus, if change occurs in the angular posture of the propellant head 1 about the axis in the course of the initial straight propelling movement of the lead-in pipe, this posture change is detected by the rolling gauge 6, and based on this detection information, the angular posture of the propellant head 1 may be corrected appropriately.

[Other Embodiments]

Figure 10:
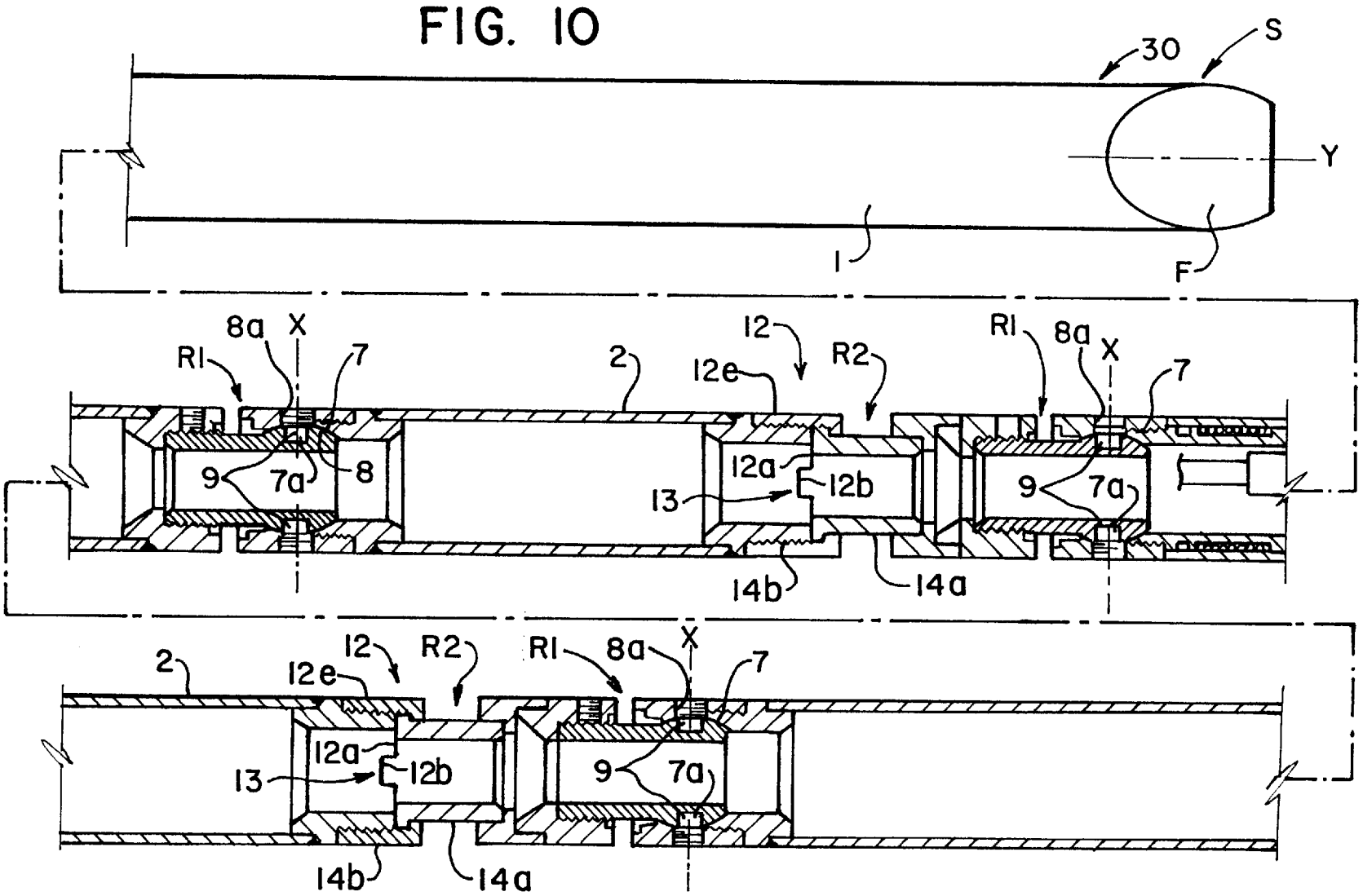
FIG. 10 is a plan view in section showing principal portions (the joint portions of plural propellant cylinders) of an underground propelling apparatus according to a further embodiment of the present invention.

(1) A propelling apparatus S according to a further embodiment of the invention is shown in FIG. 10 (showing the joined condition of plural propellant cylinders). This apparatus S includes an propelling apparatus body 30 including a propellant head 1 having substantially cylindrical outer configuration and a plurality of propellant cylinders 2 series-connected to a read end of the head 1. The apparatus body 30 includes a plurality of flexible joint portions R1 and a plurality of inflexible joint portions R2 with longitudinal spacing therebetween.

The propellant head 1, as shown in FIG. 10, is formed of a metal cylindrical member integrally having at a closed leading end thereof a pressure-receiving face F inclined relative to a head axis Y. As this pressure-receiving face F receives an earth pressure in association with a propelling movement of the apparatus, the propellant head 1 is guided to the opposite side to the orientation of the pressure-receiving face F, so that the head 1 is changed in its direction. Further, at an intermediate portion of the propellant head 1, one of the flexible joint portions R1 is provided, and this flexible joint portion R1 is uni-directionally flexible about the transverse axis X (an example of flexion axis) extending radially of the propelling apparatus body 30 and the pressure-receiving face F is formed with an orientation extending normal to the transverse axis X.

At the base end portion of the propellant head 1, one half portion 14*a* of the inflexible joint portion R2 is provided.

Each propellant cylinder 2 is formed of a metal cylinder having a small diameter of e.g. 60 mm or less. And, the cylinder 2 includes, at the leading end thereof (i.e. the forward end with respect to the propelling direction) the other half portion 14*b* detachably attachable to the one half portion 14*a* of the inflexible joint portion R2 described above. On the other hand, at the base end portion (i.e. the rear end with respect to the propelling direction) of this propellant cylinder 2, the cylinder includes a half portion 14*a*, which is identical to the half portion 14*a* of the propellant head 1. The one half portion 14*a* and the other half portion 14*b* when connected with each other together constitute the inter-connected inflexible joint portion R2.

Figure 11:
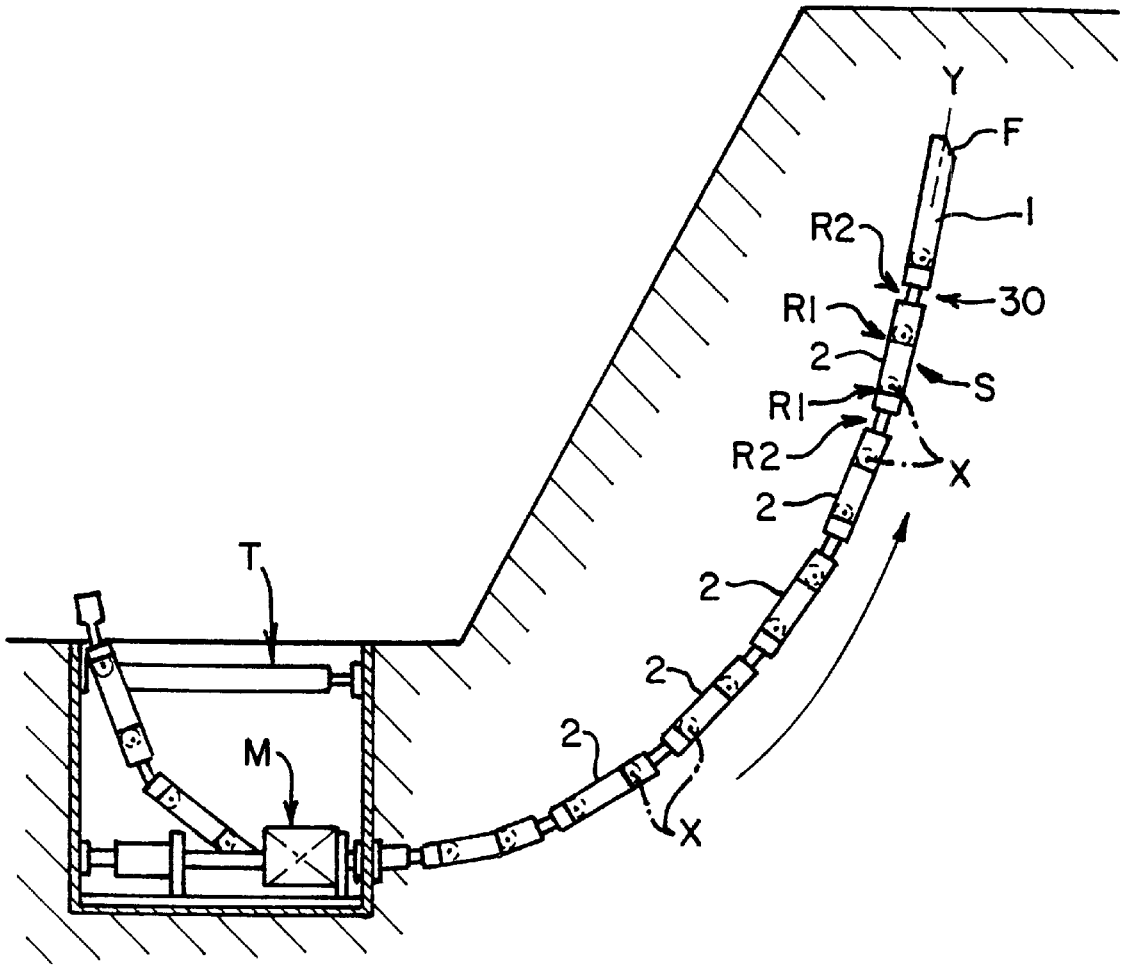
FIG. 11 is a side view illustrating a propelling process of the apparatus of FIG. 10.

As shown in FIGS. 10 and 11, at intermediate portions of one propellant cylinder 2, there are formed separately two flexible joint portions R1. And, these two flexible joint portions R1 are constructed so that the respective transverse axis X extend parallel to each other.

Now, when a propelling underground construction operation is effected by using the propelling apparatus S described above, as illustrated in FIG. 11, the propelling apparatus S is propelled under the ground toward a predetermined direction (the upwardly inclined direction in this embodiment) by means of a pushing device M. In this, when the propelling apparatus X is initially set, the propellant head 1 is fixedly set in position so as to orient its propellant head 1 downwards, and then to this propellant head 1, the propellant cylinder 2 is connected via the inflexible joint portion R2. With these, the flexion axes of the respective flexible joint portion R1 of the propelling apparatus S are oriented transversely. Then, as being pushed into the ground by the pushing device M, the propelling apparatus S may be propelled speedily with the upward inclination.

Figure 12:
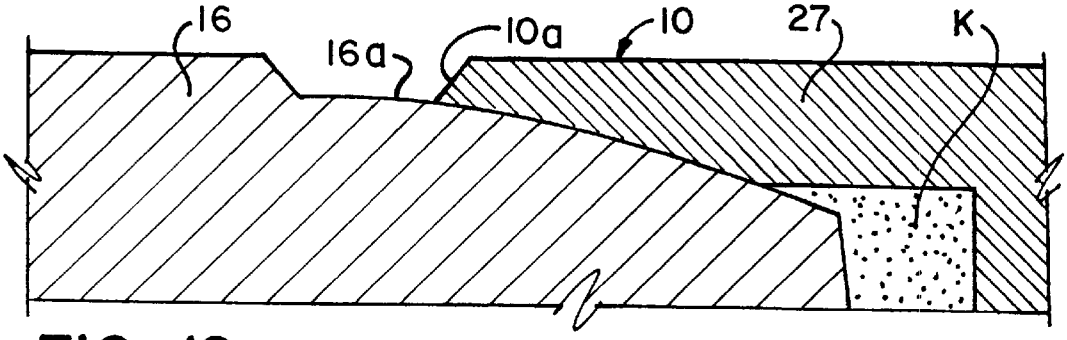
FIG. 12 is an enlarged view showing principal portions of a flexible point portion relating to a still further embodiment, FIGS. 13(*a*), (*b*) are function-descriptive views of the flexible joint portion of FIG. 12.
Figure 13A:
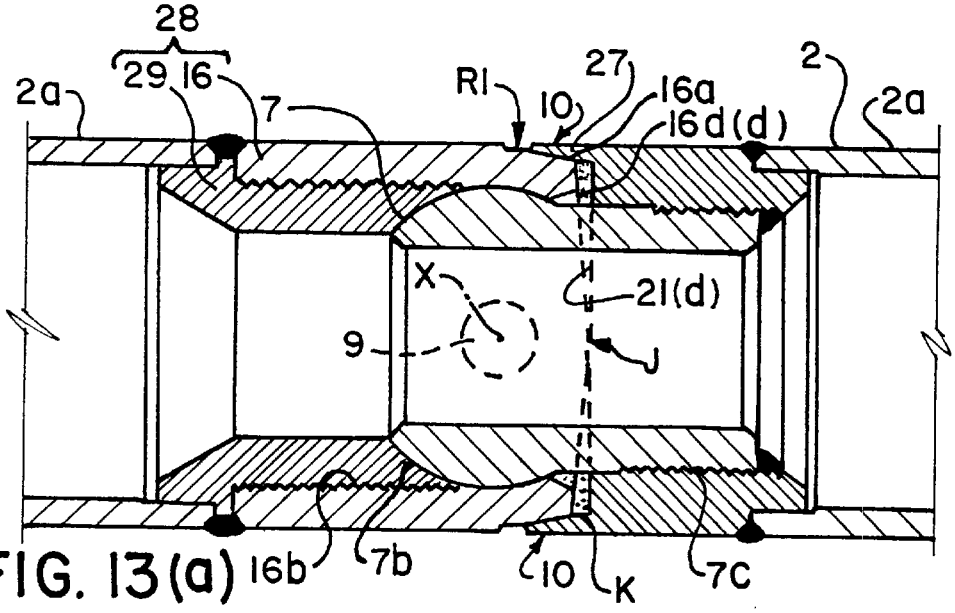
Figure 13B:
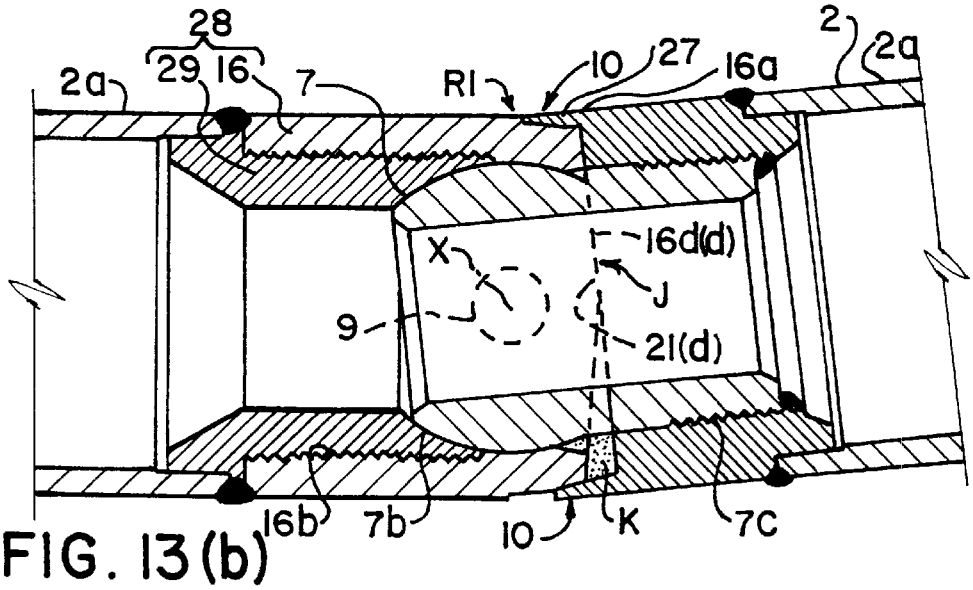
Figure 14:
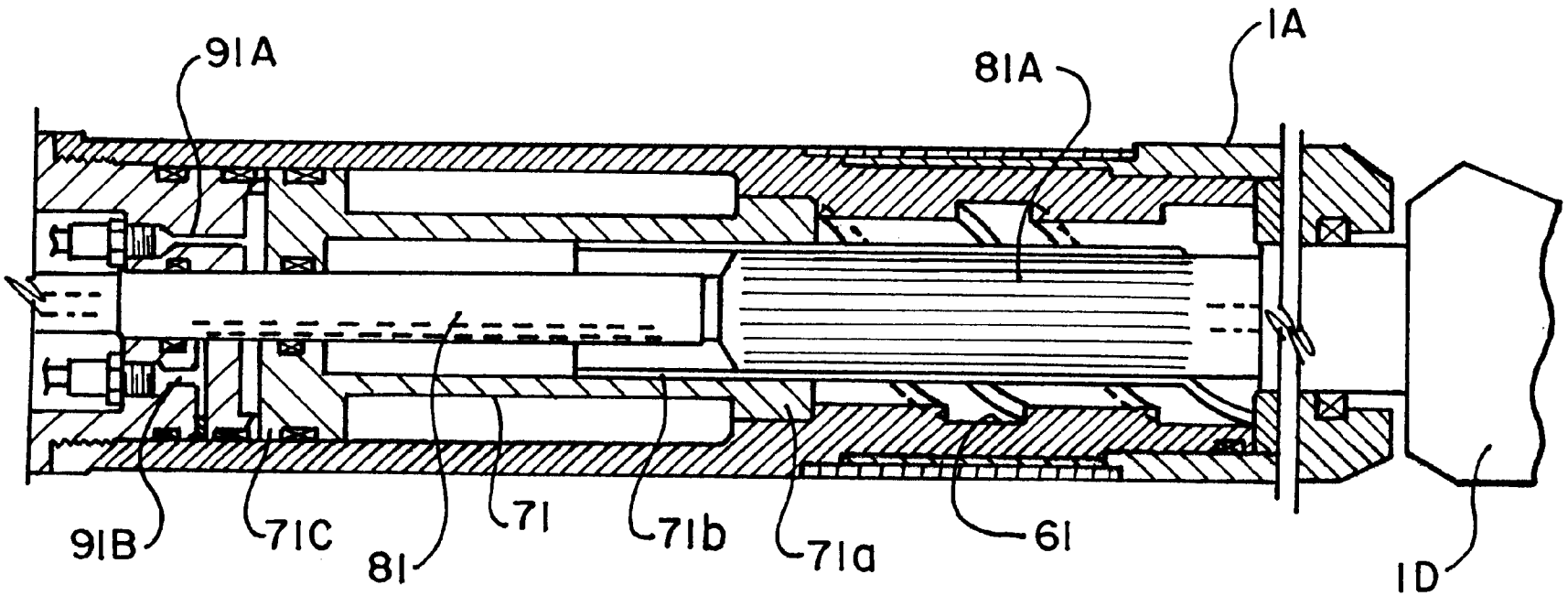
FIG. 14 (PRIOR ART)
FIG. 14 is a vertical section showing principal portions of a conventional apparatus.

(2) The flexible joint portion R1 may be alternatively constructed as shown in FIGS. 12 and 13.

This flexible joint portion R1 includes a cylindrical spherical engaging portion 28 provided at the end (forward end) of one propellant cylinder 2*a* and a spherical engaging portion 7 provided at the end (rear end) of the other propellant cylinder 2*a,* with the spherical engaging portions 7, 28 being engaged with each other. The spherical engaging portion 28 includes a cylindrical member 16 having a tapered shape and a connecting cylinder 29 threadable with a female thread 16*b* defined in the inner periphery of the cylindrical member 16 to be connected with the one propellant cylinder 2*a*. And, inner peripheral faces of the cylinder member 16 and of the end (forward end) of the connecting cylinder 29 are formed spherical concave to be fitted along the outer peripheral face of the spherical engaging portion 7. The outer peripheral face of the tapered portion of the cylinder member 16 is formed as a convex spherical face (spherical face) extending about the common flexion axis of the two propellant cylinders 2*a*. This convex spherical face portion will be referred to as a curved portion 16*a*. Also, the end face (forward end) of the tapered portion is formed as a planar portion 16*d* having two planes. The cylinder member 16 is constructed so as to cover the flexible joint portion R1 in cooperation with a sliding contact cylinder member 27 to be described later.

The spherical engaging portion 7 includes, at an end thereof, a male thread 7*c* threadable into the propellant cylinder 2*a* and also includes, at the other end thereof (forward end) a spherical portion 7*b* extending along the inner peripheral face of the one end (forward end) of the spherical engaging portion 28.

Then, the spherical engaging portions 7, 28 are connected to each other via two pins 9, so as to pivotally flexible about the transverse axis X. Incidentally, one ends of the pins 9 are fitted, in substantially gap-less manner, into recesses (not shown) formed at portions (opposing two portions) in the outer face of the spherical engaging portion 7 depth-wise along the transverse axis X. Further, the other ends of the pins 9 are threaded into threaded through holes formed at portions (two portions corresponding to the recesses) of the spherical engaging portion 28 extending along the transverse axis X. Then, with the engagement with the insertion of the opposed ends of the pins 9, the flexible joint portion R1 can be pivotally flexed about the transverse axis X.

From the end (rear end) of the propellant cylinder 2*a* engaged with the spherical engaging portion 7, there is co-extended the sliding contact cylinder member 27 for outwardly engaging the cylinder member 15 so as to cover the flexible joint portion R1.

In the inner peripheral portion of the end (rear end) of the sliding contact cylinder member 27, there is provided a sliding contact portion 10 for coming into contact with the curved portion 16*a* when the cylinder member 16 and the sliding contact cylinder member 27 are engaged with each other, so as to fill the gap between the two propellant cylinders 2*a*. This sliding contact portion 10 is constructed so as to come into face contact with the curved portion 16*a*. At the outer periphery of the end (rear end) of the sliding contact cylinder member 27, as shown in FIGS. 13(*a*) and (*b*), there is formed a tapered portion 10*a*. With this tapered portion 10*a,* it becomes possible to guide the surrounding earth to the outer side of the pipe in association with the flexing movement of the flexible joint portion R1, thereby to prevent intrusion of the earth into the hollow inner space of the flexible joint R1.

The end face portion (positioned on the inside of the sliding contact portion 10) of the propellant cylinder 2*a* is formed as a planar face. Then, in association with the flexible about the transverse axis X, on the of the two planar portions 16*d* formed at the leading end of the spherical engaging portion 28 comes into face contact therewith, thereby to restrict the maximum flexion angle between the two propellant cylinders 2*a*. The planar portions 16*d* and the end face portion 21 both correspond to an angle restricting opposed portions (d). And, the opposing direction of these angle restricting opposed portions (d) is set along the longitudinal direction of the propellant cylinder 2*a*.

Accordingly, the propellant force under the angle-restricted condition, may be transmitted between the two cylinders 2*a* by the compression force along the length of the cylinders. Therefore, this construction can transmit the force more efficiently than a further construction in which the cylinder is subjected to a large bending or shearing force. The planar portions 16*d* and the end face portion 21 will be generically referred to as an angle restricting means J.

Incidentally, a mark K in the figures denote grease filled in the space among the spherical engaging portion 7, the planar portion 16*d* and the end face portion 21. This grease functions to prevent intrusion of earth or underground water from the outside of the flexible joint portion R1 to the inside of the propellant cylinder 2 through the gap between the two propellant cylinders 2*a,* and the grease functions also to reduce the frictional resistance associated with the flexion.

(3) In the foregoing embodiment, the leader member 1D provided at the leading end of the propellant head is movable back and forth. But, this reciprocal mechanism can be eliminated. In this case, by increasing the power of the drive means for rotating the leader member 1D about the axis to improve the rotary torque, the effect of the present invention may be achieved more conspicuously.

(4) In the foregoing embodiments, the apparatuses of the invention are used for extending a gas pipe to a domestic gas piping system. Needless to say, these apparatuses may be used also for extending a water pipe to each domestic water piping system.

Further, the apparatus may be alternatively used in such a manner that the apparatus is first propelled straight and then propelled with one sidewise, i.e. right or left inclination (or, the or left direction with an inclination relative to the horizontal direction). In such case when the apparatus is propelled with the right or left inclination within a horizontal plane, it is necessary to set the flexion axes vertically.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A propelling apparatus comprising:

a plurality of propellant cylinders series-connected to each other to be propelled by receiving a pushing force from behind, each propellant cylinder having an axis extending generally along a direction which the propellant cylinder is being propelled;

joint means for series-connecting the propellant cylinders;

a propellant head connected to a forward-most end of the series-connected propellant cylinders to be pressed into the earth;

a leader member constituting a leading end of the propellant head, the leader member being rotatable relative to the propellant head about an axis of the propellant head by receiving a driving force from drive means in the propellant head;

an inclined pressure-receiving face formed at a forward portion of the leader member for receiving an earth pressure in association with the underground propelling movement of the propellant head and steering the propellant head toward the direction of application of the earth pressure to the pressure-receiving face;

wherein the joint means includes a flexible joint which is pivotally flexible substantially only about a transverse axis extending normal to the axis of each adjacent propellant cylinder.

2. A propelling apparatus as defined in claim 1, wherein the propellant head includes angular displacement detecting means for detecting change in the angular posture of the propellant head about its axis.

3. A propelling apparatus as defined in claim 2, wherein said angular displacement detecting means includes a planar rod member attached to a head body of the propellant head and suspending a weight therefrom and strain gauges affixed to front and rear faces of the rod member.

4. A propelling apparatus as defined in claim 1, wherein the flexible joint of the joint means includes one spherical engaging portion provided at the leading end of each propellant cylinder, and a further spherical engaging portion provided at the base end of each propellant cylinder and inwardly engageable with the one spherical engaging portion of an adjacent propellant cylinder, with the spherical engaging portions being interconnected to each other by connecting means to be pivotally flexible about the transverse axis.

5. A propelling apparatus as defined in claim 1, wherein the propellant head includes, in addition to the leader member, a cylindrical head body, and a drive shaft fitted within the head body to be rotatably driven about the axis of the propellant head by the drive means.

6. A propelling apparatus as defined in claim 1, wherein the series connected propellant cylinders are detachably connected to each other at an intermediate portion thereof via a registering integrating portion.

7. A propelling apparatus as defined in claim 1, wherein the joint means includes a plurality of flexible joint portions and a plurality of inflexible joint portions provided alternately in a propelling apparatus body with longitudinal spaces therebetween.

8. A propelling apparatus as defined in claim 7, wherein each of the flexible joint portions is flexible only about a flexion axis extending radially of the propelling apparatus body, and each of the inflexible joint portion includes a positioning mechanism for parallel aligning the flexion axes of the flexible joint portions disposed across this inflexible joint portion in association with a joining operation of the inflexible joint portion.

9. A propelling apparatus as defined in claim 1, wherein the pressure-receiving face is formed so as to cross the transverse axis.

10. A propelling apparatus as defined in claim 1 wherein the propellant head includes a cylindrical head body and a drive shaft within the head body to be rotatably driven about the axis of the propellant head by the drive means, wherein the drive means includes a cylinder chamber formed between the head body and the drive shaft and a blade member slidably contacting an innerperipheral face of the cylinder chamber and projecting radially for dividing the cylinder chamber into two cylinder sub-chambers.

11. A propelling apparatus as defined in claim 1 wherein the cylinder chamber includes a partitioning wall at a peripheral portion thereof forming a non-rotary region for the drive shaft.

12. A propelling apparatus as defined in claim 11 wherein the leader member is attached to the drive shaft such that the non-rotary region of the inclined pressure receiving face formed by the partitioning wall is disposed at one end of the transverse axis.

13. A propelling apparatus as defined in claim 1 wherein the joint means includes a pair of pins pivotally coupling two adjacent propellant cylinders together wherein the pair of pins is positioned along the transverse axis and substantially limits movement of the adjacent propellant cylinders to pivotable movement about the transverse axis.

14. A propelling apparatus comprising:

a plurality of propellant cylinders series-connected to each other to be propelled by receiving a pushing force from behind, each propellant cylinder having an axis extending along a direction which the propellant cylinder is being propelled;

joint means for series-connecting the propellant cylinders, wherein the joint means includes a flexible joint which is pivotally flexible substantially only about a transverse axis extending normal to the axis of each adjacent propellant cylinder;

a propellant head connected to a forwardmost end of the series-connected cylinders to be pressed into the earth;

a cylindrical head body forming part of the propellant head, the cylindrical head body including a drive shaft rotatably positioned within the head body;

a leader member constituting a leading end of the propellant head, the leader member being rotatable relative to the propellant head about an axis of the propellant head by receiving a driving force through the drive shaft of the cylindrical head body;

an inclined pressure-receiving face formed at a forward portion of the leader member for receiving an earth pressure in association with the underground propelling movement of the propellant head and steering the propellant head toward the direction of application of the earth pressure to the pressure-receiving face; and a drive means for providing the driving force to the leader member through the drive shaft, wherein the drive means includes:

a cylinder chamber formed between the head body and the drive shaft and having an annular configuration;

a blade member slidably contacting an inner peripheral face of the cylinder chamber and projecting radially for dividing capacity-wise the cylinder chamber into two cylinder sub-chambers across the drive shaft; and fluid feed openings in the head body for respectively feeding pressure fluid into the two cylinder sub-chambers divided by the blade member.

15. A propelling apparatus as defined in claim 14, wherein, between the cylinder head body and the drive shaft, the cylinder chamber includes, at a peripheral portion thereof, a partitioning wall as a non-rotary region; and the leader member is attached to the drive shaft in such a manner that the non-rotary region of the inclined pressure-receiving face formed by the partitioning wall is disposed at one terminal end of the transverse axis in the peripheral direction of the propellant head.

16. A propelling apparatus:

a plurality of propellant cylinders connected in series;

a head body connected to a forwardmost propellant cylinder;

a leader member having an inclined pressure-receiving face formed at a forward portion of the head body and attached to the head body for rotation relative to the head body; and a drive means for rotating the leader member relative to the head body, wherein the drive means includes a cylinder chamber formed within the head body and a blade member slidably contacting an innerperipheral face of the cylinder chamber and projecting radially for dividing the cylinder chamber into two cylinder sub-chambers.

17. A propelling apparatus as defined in claim 16 further including joint means for series-connecting adjacent propellant cylinders, wherein the joint means allows for pivotal movement of the adjacent propellant cylinders substantially only about a transverse axis extending normal to the axis of each adjacent propellant cylinder.

18. A propelling apparatus as defined in claim 17, wherein the cylinder chamber includes a partitioning wall at a peripheral portion thereof defining a non-rotary region for the leader member.

19. A propelling apparatus as defined in claim 18, wherein the non-rotary region of the inclined pressure receiving face of the leader member formed by the partitioning wall is disposed as one terminal end of the transverse axis.

20. A propelling apparatus as defined in claim 19 wherein the head body includes an angular displacement detecting means for detecting changes in an angular position of the head body about its axis.

* * * * *